United States Patent [19]

Roethke et al.

[11] Patent Number: 4,753,064

[45] Date of Patent: Jun. 28, 1988

[54] SPINNING OR TWISTING MACHINE WITH YARN-BREAKER RESET

[75] Inventors: Ernst Roethke, Schorndorf; Hermann Güttler, Uhingen, both of Fed. Rep. of Germany

[73] Assignee: Zinser Textilmaschinen GmbH, Ebersbach/Fils, Fed. Rep. of Germany

[21] Appl. No.: 945,409

[22] Filed: Dec. 22, 1986

[30] Foreign Application Priority Data

Dec. 20, 1985 [DE] Fed. Rep. of Germany ..... 3545412
Apr. 1, 1986 [DE] Fed. Rep. of Germany ..... 3610827

[51] Int. Cl.[4] ..... D01H 13/16; D01H 13/18; D01H 15/00

[52] U.S. Cl. ..... 57/86; 57/80; 57/87; 57/261; 57/263

[58] Field of Search ..... 57/80, 81, 84–87, 57/261, 263

[56] References Cited

U.S. PATENT DOCUMENTS

| | | | |
|---|---|---|---|
| 4,000,603 | 1/1977 | Lee, Jr. | 57/87 |
| 4,365,465 | 12/1982 | Muller et al. | 57/87 X |
| 4,444,005 | 4/1984 | Klein et al. | 57/80 |
| 4,466,236 | 8/1984 | Lagemann | 57/86 X |
| 4,472,932 | 9/1984 | Guttler et al. | 57/86 X |
| 4,581,881 | 4/1986 | Lamb | 57/87 |

FOREIGN PATENT DOCUMENTS 3133372 4/1983 Fed. Rep. of Germany .

*Primary Examiner*—John Petrakes
*Attorney, Agent, or Firm*—Karl F. Ross; Herbert Dubno

[57] ABSTRACT

The spinning or twisting machine comprises a plurality of drafting rolls, a plurality of associated spindles and positioned between them a plurality of yarn breaking devices pivotable between an upright spinning machine operating position into a yarn breaking position. According to our invention the yarn breaking device is movable by a positioning device from its yarn breaking position into an operating position.

20 Claims, 6 Drawing Sheets

SPINNING OR TWISTING MACHINE WITH YARN-BREAKER RESET

FIELD OF THE INVENTION

Our present invention relates to a spinning or twisting machine and, more particularly, to a spinning or twisting machine with a set of drafting rolls, a plurality of spindles each receiving two or more strands from the drafting rolls, and yarn breaking devices positioned between the drafting rolls and the spindles.

BACKGROUND OF THE INVENTION

Spinning and twisting machines are already known which make a twisted product from two strands of roving wound together on a spindle and run together shortly after issuing from a supply roll pair, e.g. the last pair of rolls of a drafting frame.

To avoid single strand or flawed yarn, after breakage of one roving strand, devices (yarn-breakers) are provided which also break the remaining roving strand so that both strands can be retied after spindle standstill.

One such yarn-breaker comprises a pivotable yarn breaking device with two parallel elements close to each other between which the already united roving strands run (see German Patent Document Open Patent application DE-OS No. 31 33 372).

On breakage of one of the roving strands, this yarn breaking device is tilted from a normal stable position, i.e. the operating position, by the remaining roving strand and automatically moves into a position in which both arms prevent the production of the twist in the remaining roving strand so that this strand is soon broken. This latter position is the yarn breaking position. Before refeeding the yarn to the spindle, thereby repairing the break, the yarn breaking device in these spinning machines must again be located in its normal position and the yarn fed between both parallel elements.

OBJECTS OF THE INENTION

It is an object of our invention to provide an improved spinning or twisting machine which obviates drawbacks of earlier machines and particularly those which require restoring yarn breakers to their normal positions manually.

It is also an object of our invention to provide an improved spinning or twisting machine in which it is possible to make the yarn breaking device swung from its operating position again made ready for use automatically, i.e. nonmanually and generally simultaneously at a multiplicity of locations.

SUMMARY OF THE INVENTION

These objects and others which will become more readily apparent hereinafter are attained in accordance with our invention in a spinning or twisting machine comprising a plurality of drafting rolls, a plurality of spindles and a plurality of yarn breaking devices positioned between the drafting rolls and the spindles and pivotable from an upright operating position into a yarn breaking position.

According to our invention each of the yarn breaking devices is movable from the yarn breaking position to the operating position by a movable positioning or resetting device. Because of this an automatic re-alignment of the yarn breaking device in its normal operating position is effected, whereby manual and time consuming handling is eliminated.

Our invention thus provides an automatic yarn breaker resetting mechanism in a spinning or twisting machine and simplifies the yarn resetting and restoration of twisting or spinning using automatic tying and spindle rethreaders or the like for automatically restoring operation on thread breakage.

Advantageously each positioning device has one or two positioners. Two bearing surfaces can be associated with each of the yarn breaking devices which limit the pivoting range of the yarn breaking devices into the yarn breaking position.

According to a feature of the invention at least one of the positioners simultaneously forms one of the bearing surfaces, this positioner moving the yarn breaking device into the operation position from a position in which it limits the pivoting of the yarn breaking device into the yarn breaking position.

The positioning device can also have two positioners spaced from each other whose mutual spacing from each other is only slightly greater than the width of the yarn breaking device. At least one of these positioners may be movable approximately in a straight line vertically.

In yet another embodiment of our invention at least one positioner is pivotable about a pivot axis coaxial with or adjacent and parallel to the pivot axis of the yarn breaking device.

Two oppositely pivotable positioners can be attached to one of two sleeves mounted one in the other which are rotatable by gearing. A toothed rod or rack movable by an electromagnet and a spring can be provided as a drive for the sleeves.

The positioner can be a straight arm which acts together with a pin mounted on the yarn breaking device spaced from the pivot axis of the yarn breaking device and can be movable toward the pivot axis of the yarn breaking device.

The positioner can also comprise a cam which cooperates with a pressing piece of the yarn breaking device which is movable toward the pivot axis of the yarn breaking device. The yarn breaking device and the positioning device has at least one of two axial cams producing a rotary motion, one of these cams of the yarn breaking device being mounted coaxially and axially unshiftably on a pivot axis of the yarn breaking device and the remaining is nonrotatable and movable toward that one of the cams of the yarn breaking device.

In another embodiment of our invention one of the positioners comprises a curved guide surface and the other of the positioners comprises a guide wall.

In yet another embodiment one of the positioners comprises a lifting surface and the other of the positioners comprises an opposing surface providing with a blow nozzle directed toward the yarn breaking device in a suspended condition. An inclined surface connects to the above mentioned lifting surface and the opposing surface is inclined, both the inclined surface and the opposing surface forming a conical entrance region for said yarn breaking device.

The positioning device can also be shaftlike in structure. In a spinning or twisting machine with a positioning device which is shaftlike when the yarn breaking device has a finger forming a guide slot with two exterior guiding surfaces and a funnel shaped entrance region, it is particularly desirable to make the positioning device, which can be raised, movable over the guiding surfaces of the yarn breaking device, the positioning device being located in the front portion of a yarn starting or feeding arm of a yarn starting mechanism. The positioning device can have two legs positioned opposing each other with additional guiding surfaces and the distance of the legs from each other corresponds approximately to the width of the yarn breaking device. The additional guiding surfaces can be formed by two portions positioned at an angle to each other. One of the additional guiding surfaces is positioned on an arm of a U-shaped one of the positioning devices and has a coaxial yarn guiding region positioned coaxial with a shaft of the positioning device.

In a spinning or twisting machine with a positioning device having a shaftlike structure is particularly desirable for the positioning device to have a projecting member guiding the yarn through the fingers of the yarn breaking device and is movable over the yarn breaking device in a direction inclined to the course of the yarn, the projection member raising the yarn from the pivot region of the fingers before the yarn breaking device is swung into the operation position.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
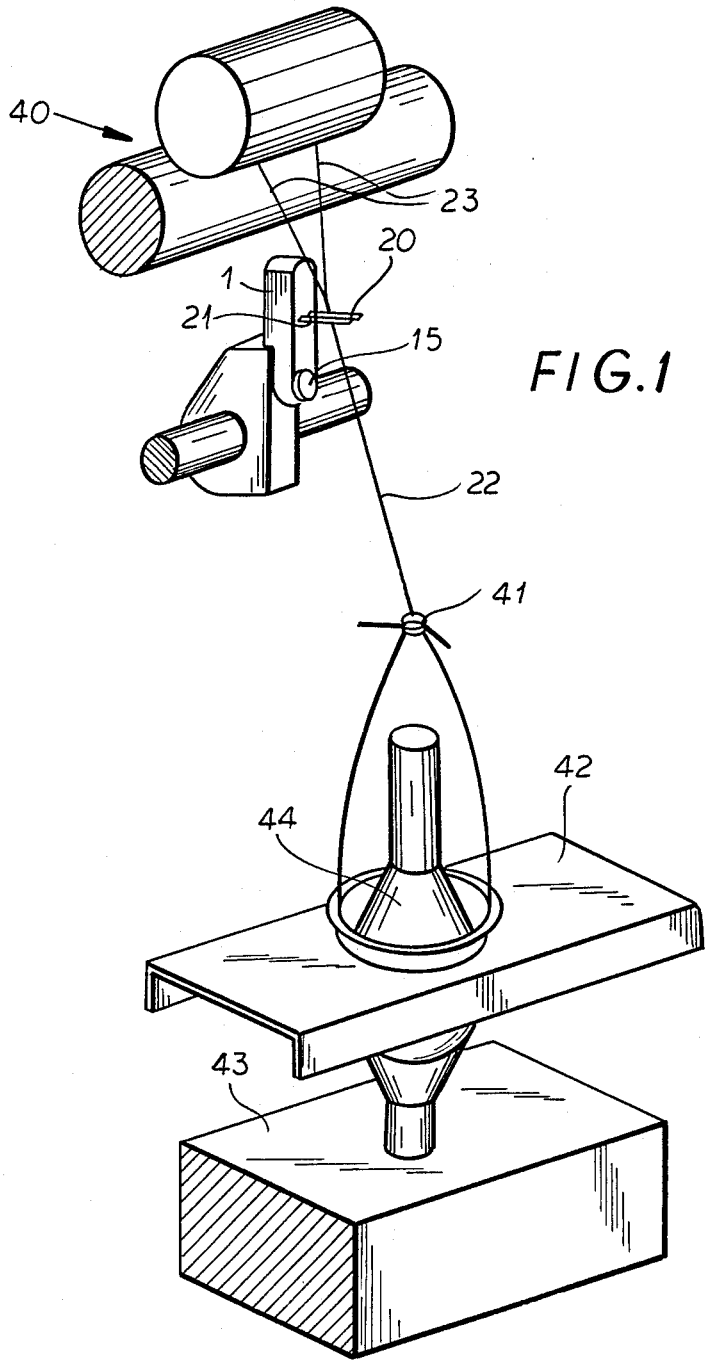
FIG. 1 is a perspective schematic view of a spinning or twisting machine with a thread breaking device in the operating position.

In FIG. 1 the final supply roll pair 40 of a set of drafting rolls of a spinning or twisting machine is shown in perspective. Under this final supply roll pair a yarn breaking device 1, which is pivotable about a pivot axis 15, can be seen in FIG. 1. This yarn breaking device 1 has two fingers 20 and 21 between which two strands of roving 23 join to form the manufactured product, yarn 22.

In FIG. 1 the arrangement is illustrated as it is in the operating position of the yarn breaking device 1, i.e. in the upright vertical position. The yarn 22 runs through a yarn guide 41 to a rotating member (e.g. a traveler, not shown, orbiting on a traveler ring) revolving in a circle, this rotating member being carried by a ring rail 42. Following that the yarn 22 is wound on a spindle 44 which is mounted on a spindle rail 43. After breaking a strand of roving 23 the yarn breaking device 1 is tilted from the vertical operating position into a yarn breaking position described below. For repairing of yarn continuity the yarn breaking device 1 must again be guided back into its upright operating position.

In the embodiment according to FIGS. 1*a* to 1*d* the yarn breaking device 1 can move in two ways from the upright operating position into a yarn breaking position I or I′ shown directed downwardly. Two bearing surfaces 3 are provided on which the yarn breaking device 1 or 1′ contacts and which are positioned in a space a engaging and holding the width of the yarn breaking device 1 or 1′. Both bearing surfaces 3 form, simultaneously, positioners 4 of the positioning device 2.

Figure 1A:
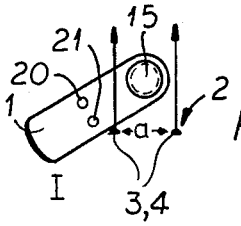
FIGS. 1*a* to 1*d* are front elevational views of a part of one embodiment of a spinning or twisting machine according to our invention in various possible positions.
Figure 1B:
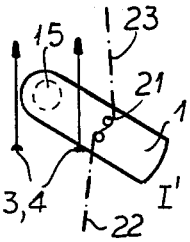
Figure 1C:
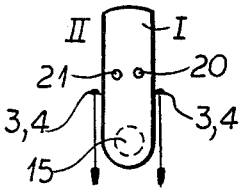
Figure 2C:
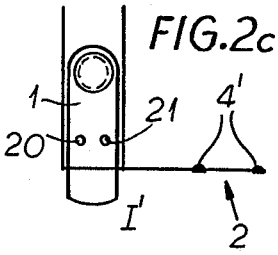

According to FIGS. 1*a* and 1*b* both positioners 4 move parallel upwardly in the direction of the arrows thus reaching the yarn breaking device 1 independently of whether it is found in position I or I′ and finally move it into the upright position II according to FIG. 1*c*.

Figure 1D:
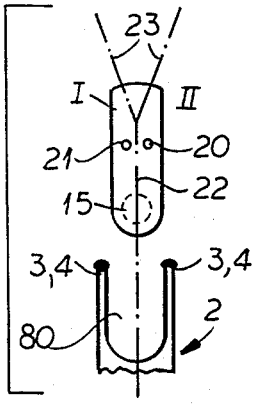

Both positioners 4 are then moved downwardly in the direction of the arrows by the positioning device so that the yarn breaking device 1 is released in the upright position according to FIG. 1*d*. Then two stands of roving 23 are fed in a way not illustrated in detail, are joined to each other, and run as the yarn 22 through both parallel fingers 20 and 21 downstream of the joining point.

From FIG. 1*d* it is also apparent, since both bearing surfaces 3 and/or the positioners 4 are arranged to be on the positioning device 2, that the positioning device 2 has a recess 80 which corresponds in width to the yarn breaking device 1 which is received therein.

FIGS. 1*a* to 1*d* show an embodiment in which the positioning device 2 only moves in a vertical direction. Thus a limit to the pivot angle of the yarn breaking device 1 is required, i.e. the yarn breaking device 1 may not be directed vertically downwardly. When the positioning device is arranged on a known travelling yarn starting mechanism, i.e. not every spinning position is provided with an individual positioning device 2, the bearing surfaces must be arranged to limit the pivot angle of the yarn breaking device 1 independently of the positioning device 2 in the machine. When in contrast the positioning device 2 is provided on every spinning position of the spinning machine, the bearing surfaces 3,3' can serve simultaneously as positioners 4,4'.

Figure 2A:
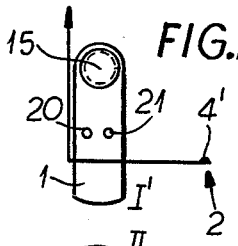
FIGS. 2*a* to 2*d* are front elevational views of a part of another embodiment of our invention corresponding to the part shown in FIGS. 1*a* to 1*d*, also shown in different positions.

FIGS. 2*a* to 2*d* show an embodiment of our invention in which the positioning device 2 is so constructed that it is movable both horizontally and also vertically according to FIG. 2*a*.

Since here according to FIG. 2*a* the yarn breaking device 1 can hang downwardly vertically in its yarn breaking position; a limit to the pivot angle of the yarn breaking device 1 in contrast is not required of FIG. 1*a*.

Figure 2B:
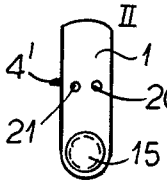

A positioner 4' as shown in FIGS. 2*a* and 2*b* is sufficient to shift the yarn breaking device 1 from its yarn breaking position I' to the operating position II. It travels first into a horizontal position until it contacts on the outer edge of the yarn breaking device 1. The motion proceeds according to FIG. 2*a* so that the yarn breaking device 1 swings around its pivot axis 15. After that the positioner 4' moves in the direction shown by the arrows vertically upwardly whereby in the course of this motion the yarn breaking device 1 reaches its operating position II according to FIG. 2*b*.

In order however to reliably shift the yarn breaking device 1 from the yarn breaking position I' to the operating position II and particularly to prevent an excessive tilt of the yarn breaking device 1 as a result of a rapid positioning motion, it is appropriate to provide a second positioner 4' which is moved jointly with the first positioner 4'. These positioners 4',4' are first moved horizontally and then vertically, whereby the yarn breaking device 1 pivoted from the yarn breaking position I according to FIG. 2*c* about its pivot axis 15 reaches the operating position II.

Figure 2D:
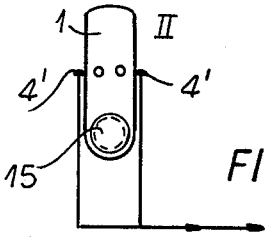

Now according to FIG. 2*d* both positioners 4' move away vertically downwardly and laterally so that the yarn breaking device 1 can freely pivot. Both positioners 4' have a spacing from each other analogous to that shown in FIG. 1 which corresponds to the width of the yarn breaking device 1.

Figure 3A:
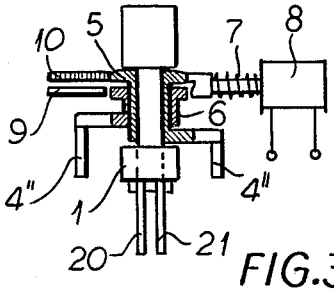
FIG. 3*a* is a top plan view, partly broken away, of the yarn breaking device in yet another embodiment of our invention.
Figure 3B:
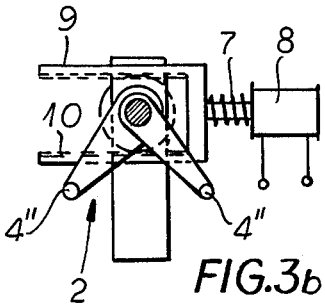
FIG. 3*b* is a partially cutaway front elevational views of the yarn breaking device in the embodiment according to FIG. 3*a;*

In the embodiment according to FIGS. 3*a* and 3*b* the positioning device 2 has two pivotable positioners 4'' running oppositely to each other. The one positioner 4'' is attached to a sleeve 5 and the other positioner 4'' is attached to a sleeve 6 which are mounted rotatably concentric to each other. Both sleeves 5 and 6 according to FIGS. 3*a* and 3*b* have a gear in the form of a toothed wheel or pinion which cooperates (meshes) with a toothed rod or rack 9 and/or 10.

The toothed rod 9 acts on the gearing of sleeve 6 from above; the toothed rod 10 acts on the gearing of the sleeve 5 from below (see FIG. 3*b*). Both toothed rods 9 and 10 are connected with each other by a connecting rod and operated by an electromagnet 8.

When this electromagnet is activated, both toothed rods 9 and 10 are moved to the right whereby the sleeves 5 and 6 are pivoted by the gearing and thus both positioners 4'' are swung in opposite senses.

Also by analogy to the structure of FIG. 1*a* for the yarn breaking device 1 which is found either in the yarn breaking position I or I' both positioners 4'' serve simultaneously as bearing surfaces. By pivoting both positioners 4'', the yarn breaking device 1 is changed from each of these yarn breaking positions to their operating position according to FIG. 1.

After these steps are finished the electromagnet 8 is involved in additional activity, namely both toothed rods 9 and 10 are moved back into their initial positions by a spring 7 and thus both positioners 4'' reach the initial positions shown in FIG. 3b by the corresponding gearing and the sleeves 5 and 6.

Figure 4A:
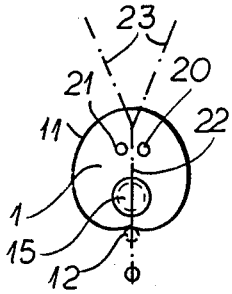
FIGS. 4*a* and 4*b* are front elevational views of an alternative embodiment of our invention in two different positions.
Figure 4B:
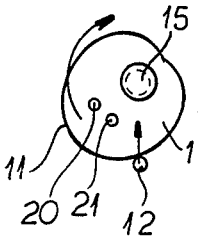

A curved positioning device or cam is also possible. According to FIGS. 4*a* and 4*b* the yarn breaking device 1 is provided with a curved disk or cam which cooperates with a pressing piece or pin 12 forming a cam follower. When the pressing piece or pin 12 moves in the direction of the arrows it rotates, according to FIG. 4*b* the yarn breaking device 1 found in the yarn breaking position in the clockwise position until it reaches the position according to FIG. 4*a*, i.e. the operating position. Also here the pin 12 acts as a bearing surface on which the curve disk contacts during tilting of the yarn breaking device 1 and whose pivoting region is bounded by it.

Figure 5A:
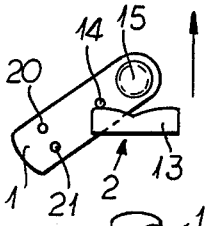
FIGS. 5*a* and 5*b* are schematic partial front elevational views of a further embodiment of our invention in two different positions.
Figure 5B:
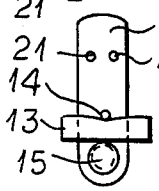

In the embodiment according to FIGS. 5*a* and 5*b* the positioning device 2 is a straight arm 13. On the yarn breaking device 1 is mounted a pin 14 which simultaneously acts as a bearing surface when it contacts on the positioning device 2, i.e. the straight arm 13. When according to FIG. 5*a* the straight arm 13 moves upwardly in the direction of the arrows, the pin 14 slides on the straight arm 13 until the change of the yarn breaking device 1 to the operating position occurs according to FIG. 5*b*, whereby again the pivoting again occurs about the pivot axis 15.

The structure of the embodiment according to FIGS. 6*a* to 6*e* is similar to that according to FIGS. 2*a* to 3*d*. In this structure according to FIGS. 6*a* to 6*e* a curved guide surface 31 and a vertical guide wall 32 define a space a. Between this curved guide surface 31 and the guide wall 32 positioned in the space a there is formed a shaft 24. The spacing of the right side of the guide surface 31 from the guide wall 32 corresponds to the width of the yarn breaking device 1 so that the positioning device 2 is movable in a horizontal direction II and in a vertical direction III.

Figure 6A:
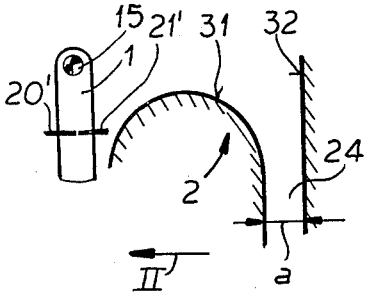
FIGS. 6*a* to 6*e* are schematic front elevational views of another embodiment of our invention with the positioning device in a variety of positions.
Figure 6B:
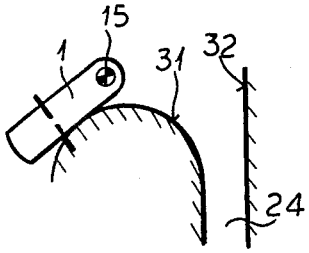

In the situation illustrated in FIGS. 6*a* and 6*b* the positioning device 2 slides from right to left in the direction of arrow II, whereby the yarn breaking device 1, suspended in its yarn breaking position, is guided along the curved surface 31 of the positioning device and thus is rotated in the clockwise direction about its pivot axis 15.

Figure 6C:
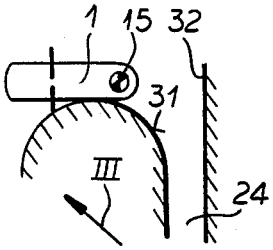
Figure 6D:
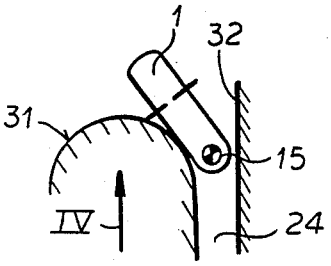
Figure 6E:
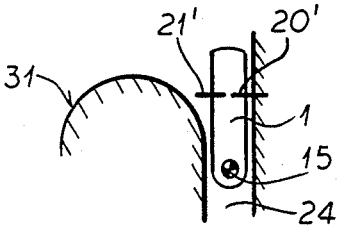

According to FIG. 6*c* the positioning device 2 moves now at an inclination upwardly in the direction of arrow III, whereby according to FIGS. 6*d* and 6*e* in the further course of the rolling of the yarn breaking device 1 on the curved surface 31 the yarn breaking device 1 by rotation about its pivot axis 15 reaches a vertical position, i.e. the operating position according to FIG. 6*e*.

When the space a corresponds to the width of the yarn breaking device 1 the yarn breaking device can reach in the shaft 24 of the shaft like positioning device 2, whereby it takes its operating position according to FIG. 6*e*. It can receive a fresh strand of roving 23 in the vicinity of the parallel fingers 20' and 21'.

Figure 7A:
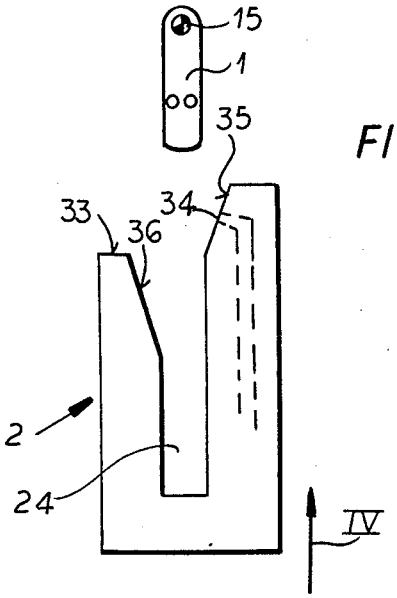
FIGS. 7*a* to 7*d* are partially cutaway schematic front elevational views of yet another embodiment of our invention including a positioning device shown during different stages of the positioning process.
Figure 7B:
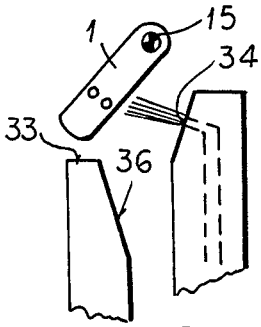
Figure 7C:
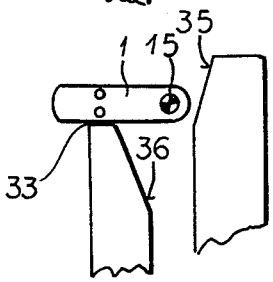
Figure 7D:
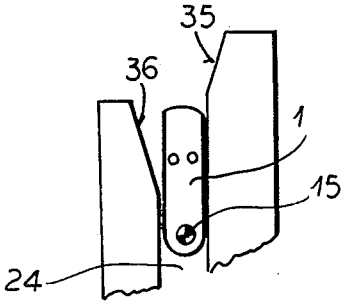

According to FIGS. 7*a* of 7*d* in one embodiment a positioning device 2 is used which operates with only one direction of motion illustrated by the arrow IV. The shaftlike positioning device 2 has a horizontal lifting surface 33 and an inclined surface 36 connected to that at an angle. Adjacent these surfaces the shaft 24 is formed which is bounded on its right side as seen in the drawing by an opposing surface 35. This opposing surface 35 is equipped with a blow nozzle 34 which is connected by a duct with a high pressure source not shown in detail in the drawing.

When according to FIG. *7a* the yarn breaking device 1 in the suspended yarn breaking position is brought by a lifting motion in the direction of the arrow IV and the nozzle 34 is put in operation as seen in FIG. *7b*, the yarn breaking device 1 pivots clockwise whereby, in the course of the lifting the motion of the yarn breaking device 1 according to FIG. *7c*, the positioning device 2 contacts on the lifting surface 33. In the course of the motion the yarn breaking device 1 reached by the inclined surface 36 according to FIG. *7d* is brought into the shaft 24 and thus into its upright operating position.

To facilitate this process two suitable opposing surfaces 35 and 36 of the positioning device 2 are provided, whereby an improvement of the operation of the yarn breaking device 1 results.

In the embodiment illustrated in FIGS. 6 and 7 holding the yarn breaking device 1 pivoted from the operating position by a bearing surface in an inclined position is unnecessary. Here the yarn breaking device 1 can be repositioned with the aid of the positioning device even from a vertical downward position. The inclined position of the yarn breaking device 1, as is illustrated in FIGS. 1*a* and 1*b*, can sometimes impair the cutting or breaking action of the yarn breaking device 1. With the structure according to FIGS. 6 and 7 this impairment can be avoided.

Figure 8:
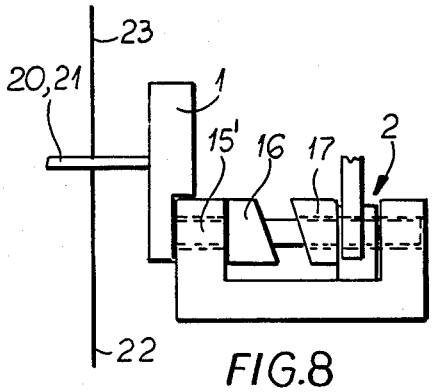
FIG. 8 is a side elevational view of an additional embodiment of our invention.

In the embodiment according to FIG. 8, a cam 16 is attached to the pivot axis shaft 15'. An opposing cam 17 forms the positioning device 2. When the yarn breaking device 1 is inclined downwardly from its operating position illustrated in FIG. 8 by travelling the cam 17 rotates on the cam 16 until a movement of the positioning device from its yarn breaking position to its operating position occurs. Thus the curvatures of the cams 15 and 16 with respect to each other are designed to be able to complete this motion. The spacing of the cams 16 and 17 in the operation position can be so selected that it limits the pivoting range of the yarn breaking device 1 in the yarn breaking position.

By the special form of the positioning device 2 in which the shaft 24 analogous to the form of FIGS. 6 and 7 is used, it is possible to put it in the known yarn starting mechanism in a spinning or twisting machine, whereby by the shaftlike shape of the positioning device 2 the yarn breaking device 1 is positioned before feeding the yarn and the yarn 22 is guided between both fingers 20 and/or 21 and/or 20' and 21'. Thus strand breaking can be moved to the automatic yarn breaking device 1 in a spinning or twisting machine and the yarn breaking device automatically positioned.

Instead of the embodiment shown in FIG. 1 the fingers 20 and 21 in the shape of pins in that embodiment can also be made from a bent wire member or from an angle plate or sheet whose front portion is so formed that a wedge like inlet region exists.

In the embodiment according to FIGS. 9 to 12 the yarn breaking device 1 has two fingers 20 and 21 between which the manufactured product comprising two strands of roving 23 joined together at a joining point, i.e. the yarn 22, runs.

Figure 9:
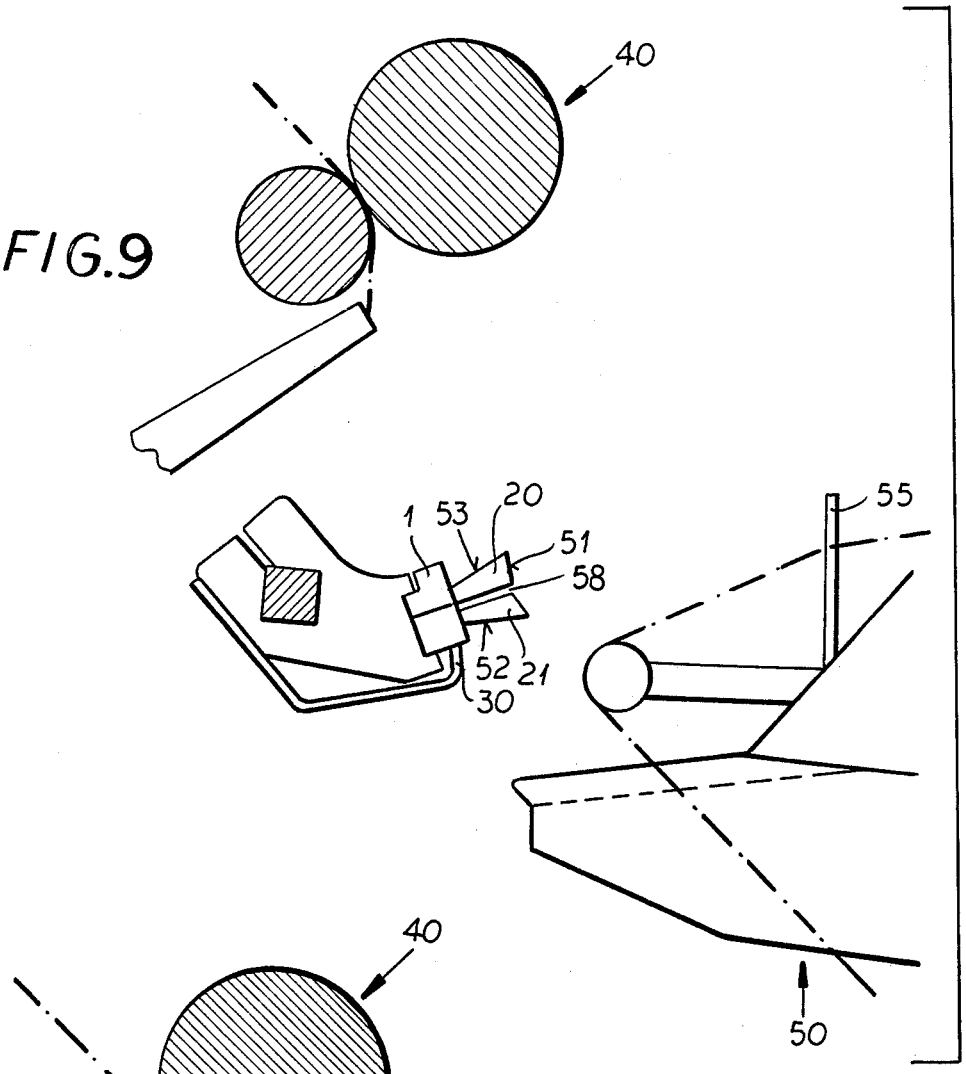
FIG. 9 is a schematic side elevational view of one embodiment of our invention showing a yarn breaking device according to FIG. 1 in a yarn breaking, i.e. tilted, position.

According to FIG. 9 a breaking of one of the strands of roving occurs so the yarn breaking device 1 pivots about its axis 15 and moves into a position in which both fingers tie up the generation of the yarn twisted in the remaining roving 23. According to FIG. 9 the yarn breaking device 1 contacts on a bearing or contacting member 30 which bounds the pivot region of the yarn breaking device 1. This contacting member 30 has two bearing surfaces 30*a* and 30*b* according to FIGS. 11 and 12. In the situation shown in FIG. 9 the yarn breaking device 1 contacts on the bearing surface 30*b*; a break of a strand of roving 23 has occurred.

Figure 10:
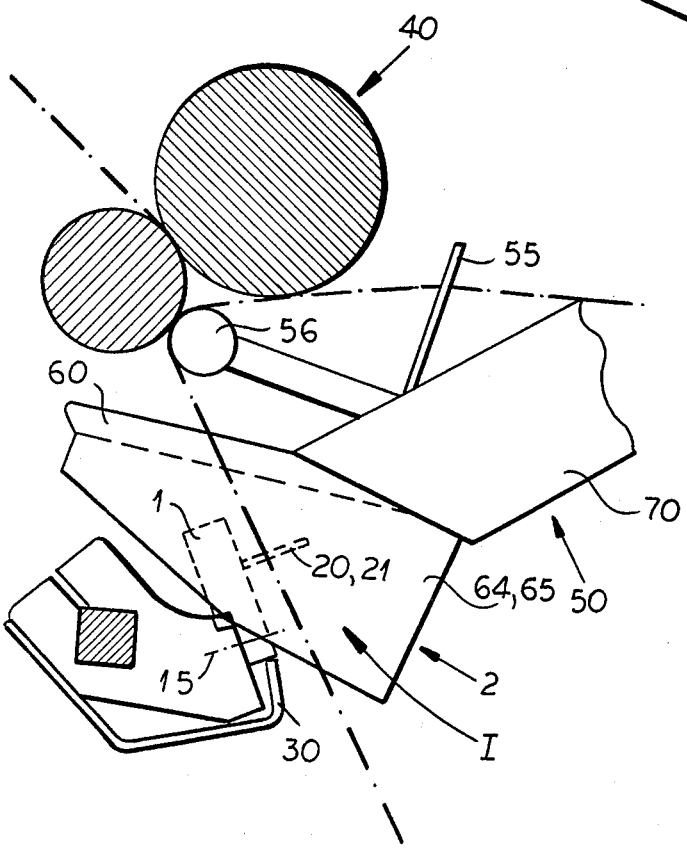
FIG. 10 is a schematic side elevational view of a yarn breaking device being oriented by the positioning device.

Now the schematically illustrated yarn starting or refeeding mechanism 50 shown in FIGS. 9 and 10 functions and inserts the broken roving automatically into the spindle path. For this purpose, as is known, one kind of yarn starting mechanism is equipped with a device with which it stops the spindle, searches for and pulls away the end of the broken strand of roving, hangs it in the running member and the yarn guide as shown in FIG. 1 and subsequently combines it with the strand of roving 23 issuing from the supply roll pair 40 of the spinning or twisting machine.

This known yarn starting mechanism is equipped, according to the invention on its yarn starting arm 70 in the front vicinity with a positioning device 2 which allows it to guide back the pivotable yarn breaking device 1 from the operating position according to FIG. 9 before feeding the yarn again into the operating position.

Figure 11:
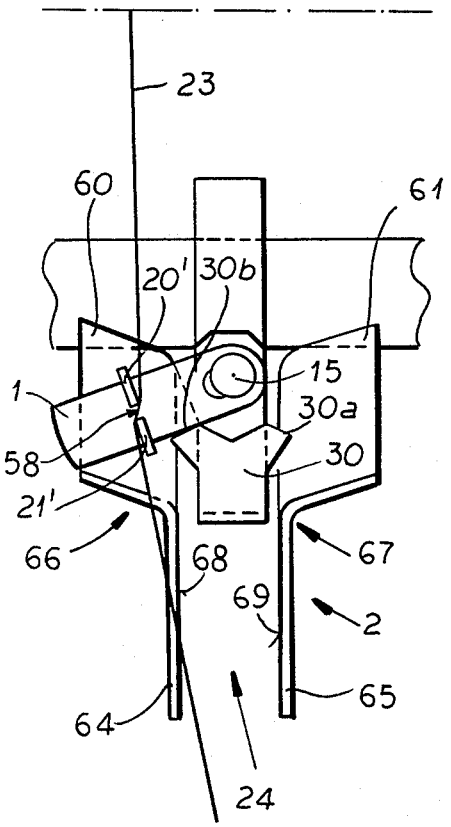
FIG. 11 if a front elevational view of the tilted yarn breaking device of FIG. 9 shortly before the start of operation of the positioning device.
Figure 12:
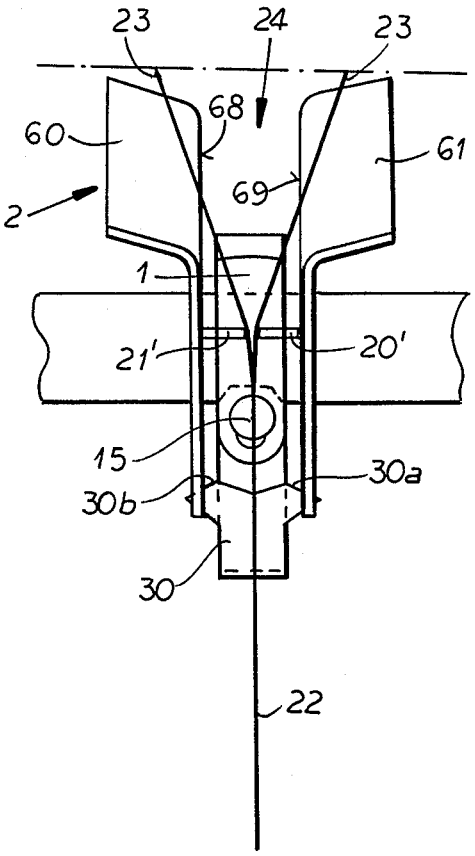
FIG. 12 is a front elevational view of the adjusted yarn breaking device of one embodiment of our invention shown between the shaftlike positioning device.

The positioning device 2 comprises a shaft like positioner which has two arms 64 and 65 positioned opposite each other according to FIGS. 11 and 12. These arms 64 and 65 have guiding surfaces 66 and 67. The spacing of the arms 64 and 65 from each other corresponds as can be seen from FIG. 11 approximately to the width of the yarn breaking device 1.

The guiding surfaces 66 and 67 are formed from two portions 68 and 69 and/or 60 and 61 set at an angle to each other.

To position the yarn breaking device 1 found in its tilted position according to FIG. 9, i.e. its contact on the surface 30b of the contacting or bearing member 30, the yarn starting arm 70 pivots in the direction of arrow I according to FIG. 10, whereby according to FIG. 11 the tilted yarn breaking device 1 contacts on the portion 60 and on further motion reaches the portion 68 by the inclined surface of portion 60. This motion is performed until the position as shown in FIG. 12 is reached.

Thus the yarn breaking device 1 with the aid of the yarn starting mechanism 50 and the positioning device 2 is positioned. This positioning must be completed when the yarn starting roll 56 starts to guide the yarn 22 into the guide slot 58. To make introduction of the yarn in the guide slot 58 easier according to FIG. 9, the yarn breaking device 1 having both fingers 20 and 21 has a funnel like entrance region 51. Further the fingers 20 and 21 are so formed that they have outer guiding surfaces 52 and 53 according to FIG. 9 which cooperate with the corresponding portions 60 and 61 and/or 68 and 69 of the shaft like positioning device 2.

Figure 13:
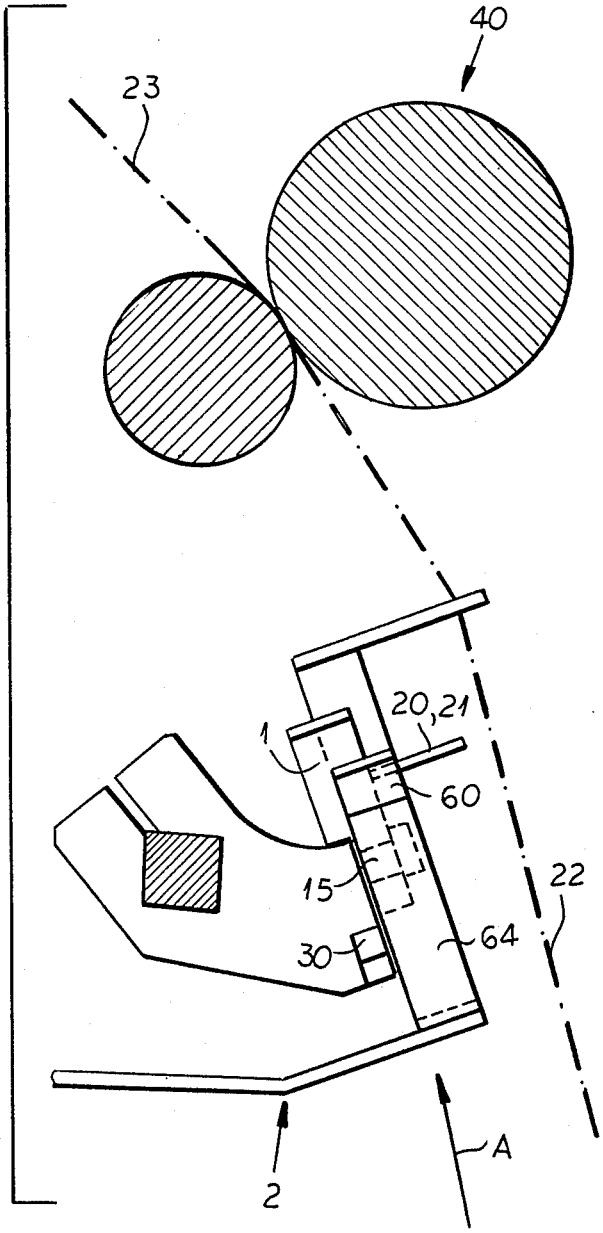
FIG. 13 is a schematic side elevational view of another embodiment of the positioning device in our invention.
Figure 14:
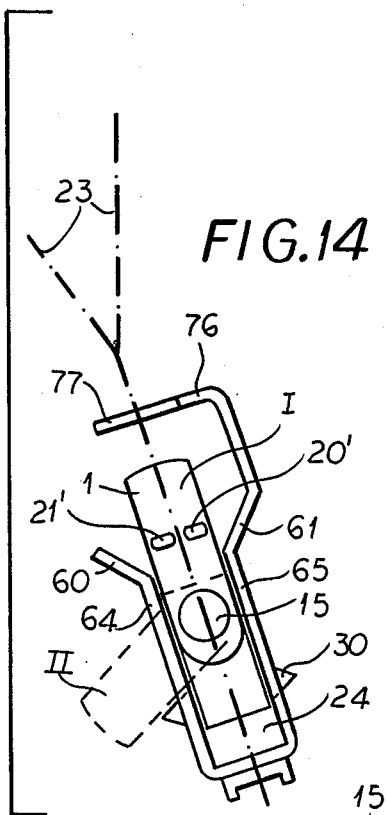
FIG. 14 is a schematic front elevational view of the positioning device according to FIG. 13.
Figure 15:
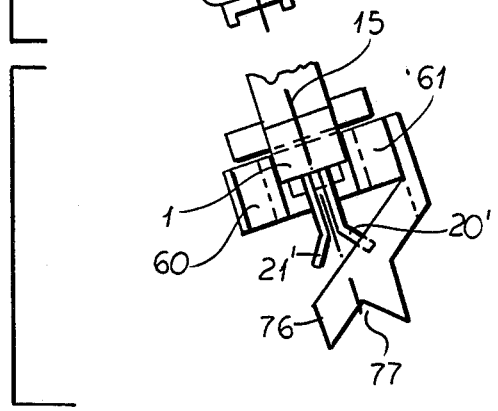
FIG. 15 is a schematic top plan view of the positioning device according to FIGS. 13 and 14.

In FIGS. 13 to 15 an embodiment of the invention is shown which allows movement of a yarn breaking device 1 from a yarn breaking position I into its operating position II after which the yarn breaking is removed and also again the yarn is inserted between the fingers 20' and 21'.

The positioning device 2 is U-shaped and has two legs 64 and 65 with a funnel shaped entrance region for the yarn breaking device 1 with the sections or portions 60 and 61. The supporting piece of the yarn breaking device 1 is provided with a bearing surface 30 which determines the yarn breaking position of the yarn breaking device 1. The leg 65 has a projecting section 76 with a wedge shaped groove 77.

In this embodiment the yarn break is repaired while the yarn breaking device 1 remains in its yarn breaking position II. The fingers 20' and 21' lie alongside the strand path and do not prevent yarn break repair. When the yarn runs again, the positioning device 2 pivots upwardly in an arc A about a pivot point lying left in FIG. 13. The wedge shaped yarn guiding groove 77 presses the yarn 22 to the right as shown in FIG. 13 and lifts it out of the motion path of the fingers 20' and 21', described during subsequent pivoting of the yarn breaking device 1, into the operative position.

On further upward motion of the positioning device 2, the legs 64 and 65, with their wedge shaped entrance region formed by the sections 60 and 61, slide from below over the yarn breaking device 1 and pivot it upwardly. It enters than into the shaft like region 24 of the positioning device 2 and is stabilized in that position.

In subsequent downward motions of the positioning device 2 the yarn guiding groove 77 slide the yarn 22 back again into its straight course and threads it between the fingers 20' and 21'.

The described method of operation sets forth that the positioning device 2 moves upwardly inclined by the running yarn behind the curved or linear running yarn. It is advantageous to provide such a positioning device for each spinning position. It can be operated by an automatic yarn starting mechanism. However even with manual removal of a broken thread it considerably hastens this manipulation, since it mechanizes the positioning requiring a certain tactile sensitivity in the narrow stabilizing region of its operating position and the feed of the running yarn between the fingers.

We claim:

1. In a spinning or twisting machine comprising a plurality of drafting roll, a plurality of spindles and positioned therebetween a respective yarn breaking device for each spindle pivotable from an operating position into a yarn breaking position, the improvement wherein each of said yarn breaking devices is provided with a positioning means for automatically moving each yarn breaking device from said yarn breaking position into said operating position.

2. The improvement according to claim 1 wherein said position means has up to two positioners engageable with the respective yarn breaking device.

3. The improvement according to claim 2 comprising two bearing surfaces associated with each of said yarn breaking devices which limit the pivoting range of the respective yarn breaking device into the yarn breaking position.

4. The improvement according to claim 3 wherein at least one of said positioners for each yarn breaking device simultaneously forms one of said bearing surfaces, said one of said positioners being moveable to displace said yarn breaking device into said operating position, and limiting the pivoting of said yarn breaking device in said yarn breaking position.

5. The improvement according to claim 2 wherein said positioning means has two positioners with a mutual spacing from each other slightly greater than a width of the yarn breaking device.

6. The improvement according to claim 2 wherein at least one of said positioners is movable approximately in a straight line vertically.

7. The improvement according to claim 2 wherein at least one positioner is pivotable about a pivot axis and parallel to a pivot axis of said yarn breaking device.

8. The improvement according to claim 7 further comprising two sleeves mounted one in the other which are rotatable by gearing and wherein two oppositely pivotable cooperating ones of said positioners for each yarn breaking device are respectively attached to one of said two sleeves.

9. The improvement according to claim 8 further comprising a drive having a toothed rod, an electromagnet, and a spring wherein said toothed rod is movable by said electromagnet and said spring, said drive being provided to move said sleeves.

10. The improvement according to claim 2 further comprising a pin mounted on said yarn breaking device spaced from the pivot axis of said yarn breaking device and wherein a said positioner is a straight arm which acts together with said pin and is movable toward the pivot axis of said yarn breaking device.

11. The improvement according to claim 2 further comprising a pressing piece of said yarn breaking device and wherein a said positioner comprises a cam which acts together with said pressing piece of said yarn breaking device and which pressing piece is movable toward the pivot axis of said yarn breaking device.

12. The improvement according to claim 2 wherein said yarn breaking device and said positioning means has at least one of two axial cams producing a rotary motion, one of said cams of said yarn breaking device being mounted coaxially and axially unshiftably on a pivot axis of said yarn breaking device and the remaining one of said cams of said positioning means being nonrotatable and movable toward said one of said cams of said yarn breaking device.

13. The improvement according to claim 2 wherein one of said positioners comprises a curved guide surface and the other of said positioners comprises a guide wall.

14. The improvement according to claim 2 wherein one of said positioners comprises a lifting surface and the other of said positioners spaced from said one of said positioners comprises an opposing surface provided with a blow nozzle directed toward said yarn breaking device in a downwardly hanging condition thereof.

15. The improvement according to claim 14 wherein an inclined surface connects to said lifting surface and said opposing surface is inclined, both said inclined surface and said opposing surface forming a conical entrance region for said yarn breaking device.

16. The improvement according to claim 2 further comprising a yarn starting mechanism having a yarn starting arm and wherein said positioning means is shaftlike in structure and said yarn breaking device has a finger forming a guide slot with two exterior guiding surfaces and a funnel shaped entrance region, said positioning means being arranged for movement over said guiding surfaces of said yarn breaking device, said positioning means being positioned in a front portion of said yarn starting arm.

17. The improvement according to claim 16 wherein said positioning means has two legs positioned opposite one another with additional guiding surfaces and the distance of said legs from each other corresponds approximately to the width of said yarn breaking device.

18. The improvement according to claim 17 wherein said additional guiding surfaces are formed by two portions of said surfaces positioned at an angle to each other, one of said additional guiding surface being positioned on an arm of a U shaped one of said positioning means and having a coaxial yarn guiding region positioned coaxial to a shaft of said positioning means.

19. The improvement according to claim 16 wherein said positioning means has a projecting member guiding said yarn through said fingers of said yarn breaking device and is movable over said yarn breaking device in a direction inclined to the course of said yarn, said projecting member raising said yarn from the pivot region of said fingers before said yarn breaking device is swung into said operating position.

20. The improvement according to claim 1 wherein said positioning means is positioned on an automatic yarn starting mechanism.

* * * * *